US006565136B1

(12) United States Patent
Parker

(10) Patent No.: US 6,565,136 B1
(45) Date of Patent: May 20, 2003

(54) LIFTING DEVICE FOR PALLETIZED LOADS

(76) Inventor: Michael J. Parker, 618 Northport La., Kemah, TX (US) 77565

( * ) Notice: Subject to any disclaimer, the term of this patent is extended or adjusted under 35 U.S.C. 154(b) by 0 days.

(21) Appl. No.: 10/008,312

(22) Filed: Nov. 3, 2001

(51) Int. Cl.[7] ..... B66C 1/26

(52) U.S. Cl. ..... 294/67.2; 294/82.24

(58) Field of Search ..... 294/63.1, 67.1, 294/67.2–67.21, 67.3, 67.4, 67.5, 74, 75, 81.1, 81.5, 81.55, 81.56, 82.1, 82.11, 82.24, 82.31

(56) References Cited

U.S. PATENT DOCUMENTS

| | | | | |
|---|---|---|---|---|
| 762,875 A | | 6/1904 | Blodgett | |
| 1,742,384 A | * | 1/1930 | Fitzgerald | 294/67.2 X |
| 1,834,902 A | | 12/1931 | Payzant | |
| 1,918,007 A | | 7/1933 | Woodruff | |
| 2,133,557 A | * | 10/1938 | McNeillie | 294/67.2 |
| 2,690,926 A | * | 10/1954 | Betz | 294/67.21 |
| 2,700,568 A | | 1/1955 | Meili | |
| 3,314,711 A | * | 4/1967 | Dietz et al. | 294/67.5 |
| 3,519,302 A | | 7/1970 | Orenstein | |
| 3,655,068 A | * | 4/1972 | Ervin | 294/67.5 X |
| 4,550,940 A | | 11/1985 | Schweikert | |
| 4,826,228 A | | 5/1989 | Dintitz et al. | |

FOREIGN PATENT DOCUMENTS

| | | | | |
|---|---|---|---|---|
| DE | 3736323 | * | 5/1989 | 294/67.2 |
| SU | 380577 | * | 7/1973 | 294/67.2 |
| SU | 779255 | * | 11/1980 | 294/67.22 |
| SU | 975556 | * | 11/1982 | 294/67.2 |

* cited by examiner

*Primary Examiner*—Dean J. Kramer
(74) *Attorney, Agent, or Firm*—Browning Bushman, P.C.

(57) ABSTRACT

A lifting device for a pallet comprising a rigid lower L-shaped lifting frame having a pair of lower rigid legs for inserting within openings in a pallet having a load thereon. The L-shaped lifting frame includes upwardly extending back frame members extending upwardly from the lower lifting legs. A pair of cables are connected to the back frame members and another pair of cables are connected to the free ends of the lower lifting legs. For connecting the lifting device onto the pallet, the front cables connected to the free ends of the legs are disconnected so that the legs may be inserted within openings in the pallet with free ends of the legs extending from the pallet. Then, the front cables are reconnected to the lifting legs for lifting of the pallet and load thereon.

18 Claims, 2 Drawing Sheets

FIG.1
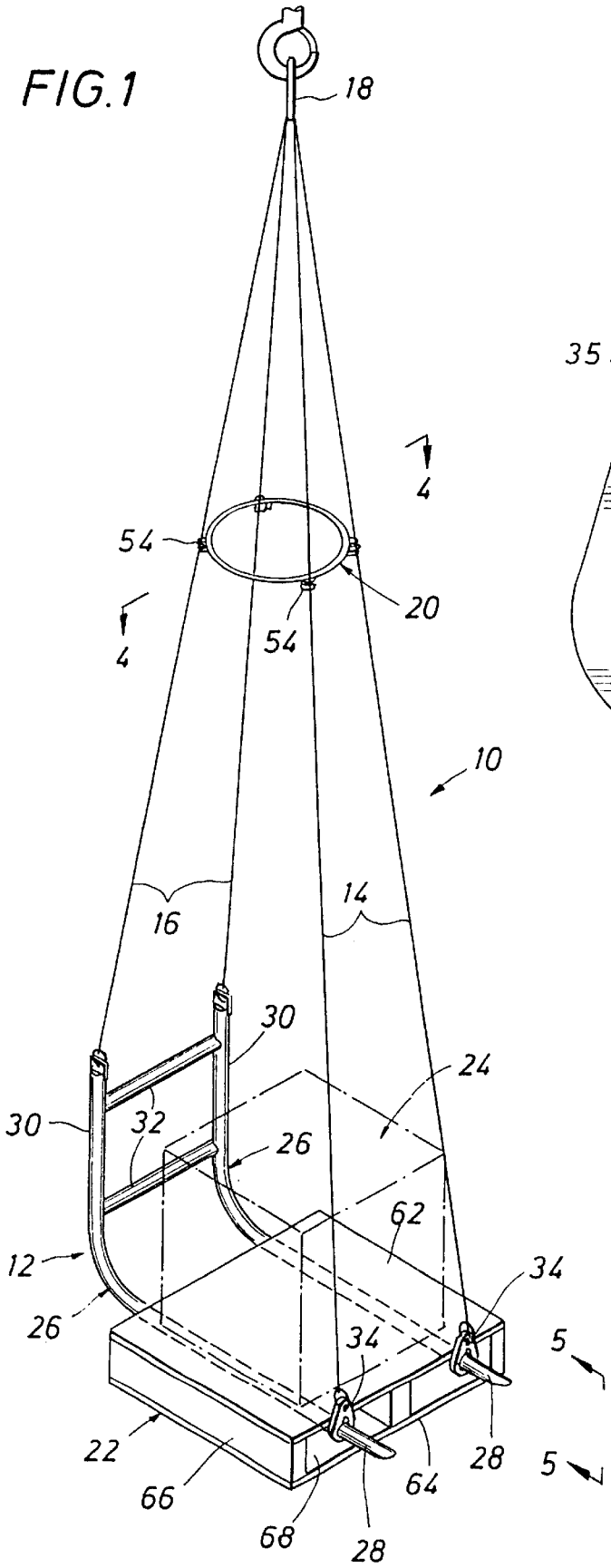
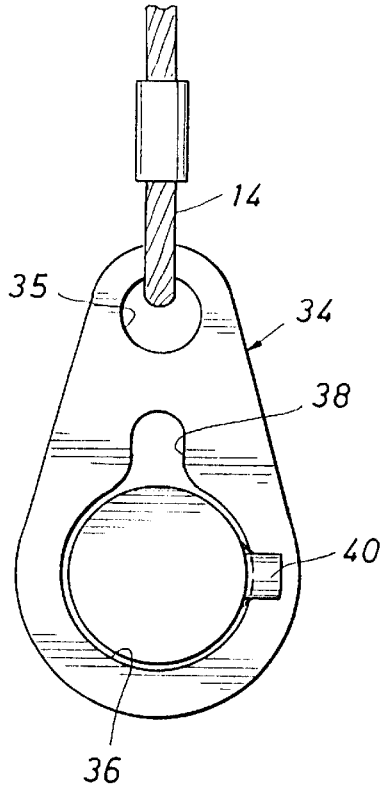
FIG.5

LIFTING DEVICE FOR PALLETIZED LOADS

FIELD OF THE INVENTION

This invention relates to a lifting device for a palletized load, and more particularly to a lifting device having a rigid lifting frame received within openings of a pallet and supported from flexible cables.

BACKGROUND OF THE INVENTION

Heretofore, various lifting devices for palletized loads have been provided in which a crane is effective to lift the palletized load by cables connected to the lifting device. For example, U.S. Pat. No. 4,550,940 shows a lift mechanism which includes a pair of separate lift units connected to the pallet. Each lift unit must be separately connected to the pallet. Such an arrangement requires a relatively complex connection to the pallet and is time consuming.

Loaded pallets are lifted and transported from one area or location to another such as when loading or unloading ships, flatbed trucks, or trains. When loading or unloading pallets from ships, the ship may be rolling or pitching due to various sea conditions and it is necessary that a safe transfer of the palletized load be made. Palletized loads are often stacked vertically on ships or the like, and a lifting device should be easily connected to an upper stacked palletized load for lifting and transfer to another location or area.

A pallet normally has lower stringers mounted between upper planking and lower planking to define an opening between the upper planking which supports the load and the lower planking which is mounted on a supporting surface. A lifting device normally has lift members received within the opening of the pallet between the upper and lower planking for contacting and lifting of the pallet.

It is desired that a lifting device for palletized loads be provided that is easily connected to the palletized load for lifting in a relatively simple manner in a minimum of time.

SUMMARY OF THE INVENTION

The present invention includes a rigid lower L-shaped lifting frame connected to a plurality of support cables for lifting of the palletized load. The rigid L-shaped lifting frame has a pair of lower parallel lift legs which fit in openings in the pallet and a back for fitting against a side of a pallet or palletized load. The free ends of the legs opposite the back extend through the pallet openings and outwardly of the pallet. Lift cables are connected to the back and to the free ends of the legs. The cables connected to the free ends of the legs are manually released or unhooked from the legs prior to insertion of the legs within the openings of the pallet. After the legs are inserted within the openings, the cables are reconnected to the legs for lifting of the palletized load.

The rigid L-shaped lifting frame is a rigid one-piece integral frame and when the cables are unhooked from the free end of the legs, the frame tilts at an angle from the rear support cables connected to the back of the lifting frame. The legs of the tilted frame are particularly easy to insert within openings in upper vertically stacked loaded pallets.

Another feature of the invention is the provision of a floating spreader ring connected to the four cables for maintaining the cables in spaced relation to each other without twisting of the cables when the lifting frame is unloaded. The spreader ring may move along the cables for maintaining the cables in a straight direction from the lifting frame to the lift ring at the upper ends of the cables.

It is an object of the invention to provide a lifting device for a palletized load which is easily connected to the palletized load for lifting in a minimum of time.

It is a further object of the invention to provide such a lifting device including a one-piece rigid L-shaped lifting frame supported by cables connected to the one-piece rigid lifting frame.

An additional object is to provide such an L-shaped rigid lifting frame having cables releasably connected to the free ends of the lower lifting legs with the cables being released from the free ends of the legs for insertion of the legs within openings of a pallet, and then reattached to the legs for lifting of the pallet.

A still further object is the provision of a rigid lifting frame supported from four cables and having a spacer ring to maintain spacing of the cables and to minimize twisting of the cables and lifting frame in an unloaded condition.

It is still another object of the invention to provide a lifting device with a minimum of operating parts required, is inexpensive to manufacture, and is easily attached to a palletized load for lifting.

Other objects, features, and advantages of the invention will be apparent from the following specification and drawings.

BRIEF DESCRIPTION OF THE DRAWINGS

FIG. 1 is a perspective view of the lifting device comprising the present invention shown lifting a palletized load;

FIG. 5 is a front elevational view of the releasable front cable connection to the lifting frame taken generally along line 5—5 of FIG. 1.

DESCRIPTION OF THE INVENTION

Figure 2:
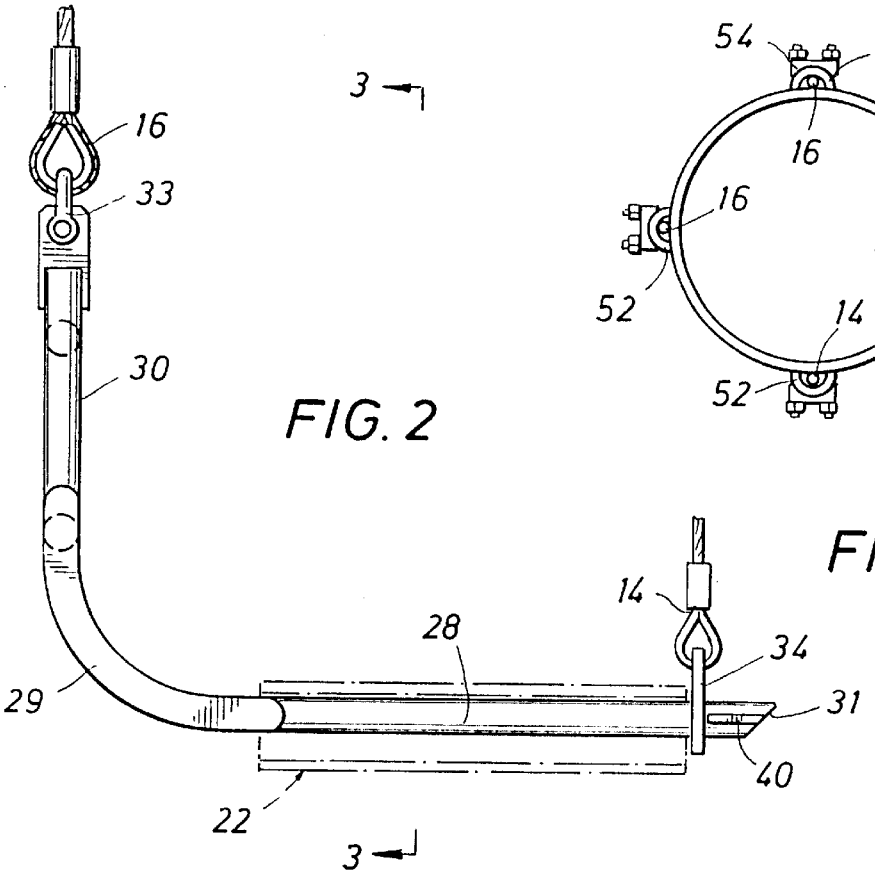
FIG. 2 is an enlarged side elevational view of the rigid L-shaped lifting frame shown in FIG. 1 with the cables for connection to the free ends of the lifting legs being released from the legs to permit insertion of the legs within openings of a pallet.

Referring particularly to FIG. 1, a lifting device 10 forming the present invention has a rigid lower L-shaped lifting frame generally indicated at 12 supported by a pair of front cables 14 and a pair of rear cables 16. Cables 14 and 16 are connected to a lift ring 18 which may be lifted by a suitable crane or the like. A spreader member is shown generally at 20 slidably connected to cables 14 and 16 for maintaining cables 14 and 16 in a spaced relation to each other. A pallet shown generally at 22 supports a load 24 thereon for transport of load 24 from one location to another location.

Referring now to FIG. 2, rigid L-shaped lifting frame 12 is an integral one-piece construction including a pair of rigid parallel L-shaped side frame members 26 defining lower horizontal lifting legs 28 and vertical back frame members 30 extending at right angles to lift legs 28. Cross frame members 32 extend between and connect back frame members 30. A reinforcing rib or gusset 29 is secured between each leg 28 and back frame member 30 on an outer side thereof. If desired, a reinforcing gusset may also be provided on an inner side of leg 28 and back frame member 30. A clevis 33 is connected to the upper end of each back frame member 30 and cable 16 is looped about clevis 33 for securement.

For releasably connecting front cables 14 to legs 28, a link 34 is mounted on the end of each front cable 14. Each link 34 has an upper opening 35 receiving a loop of front cable 14 as shown in FIG. 5. A large diameter opening 36 receives the free end 31 of leg 28 and has a groove 38 communicating with opening 36. A lug 40 on the outer side periphery of leg 28 is adapted to be received within groove 38 upon rotation of link 34 ninety degrees from the position shown in FIG. 5 to permit link 34 to be slipped over the free end 31 of leg 28 past lug 40, and then rotated ninety degrees back to the position shown in FIG. 5 for lifting of pallet 22. Lug 40 with link 34 in the lifting position of FIG. 5 blocks the removal of link 34 from leg 28 when cable 14 is in a taut lifting position to maintain link 34 in the lifting position. Front cables 14 are releasably connected by links 34 to the free front ends 31 of lifting legs 28.

Figure 4:
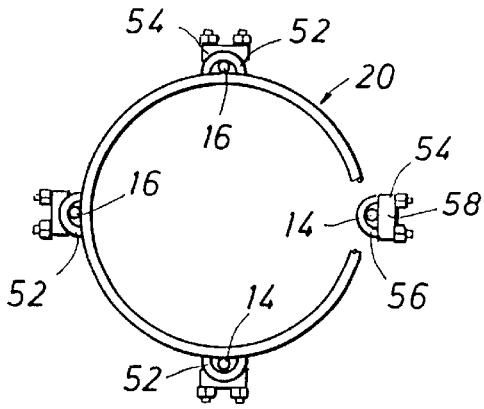
FIG. 4 is a top plan view of a spreader ring connected to the cables taken generally along line 4—4 of FIG. 1.

Referring to FIG. 4, spreader member 20 has a plurality of eyes 52 receiving cables 14, 16 in sliding rotation to hold cables 14, 16 in a spaced relation to each other. Stops 54 limit downward movement of spreader member 20 and are secured to the cables at a location so that spreader member 20 when in contact with stops 54 maintains the cables in a generally straight position between upper ring 18 and frame 12. The stops 54 comprise a U-bolt 56 received within a plate 58 for gripping cables 14, 16 therebetween.

Figure 3:
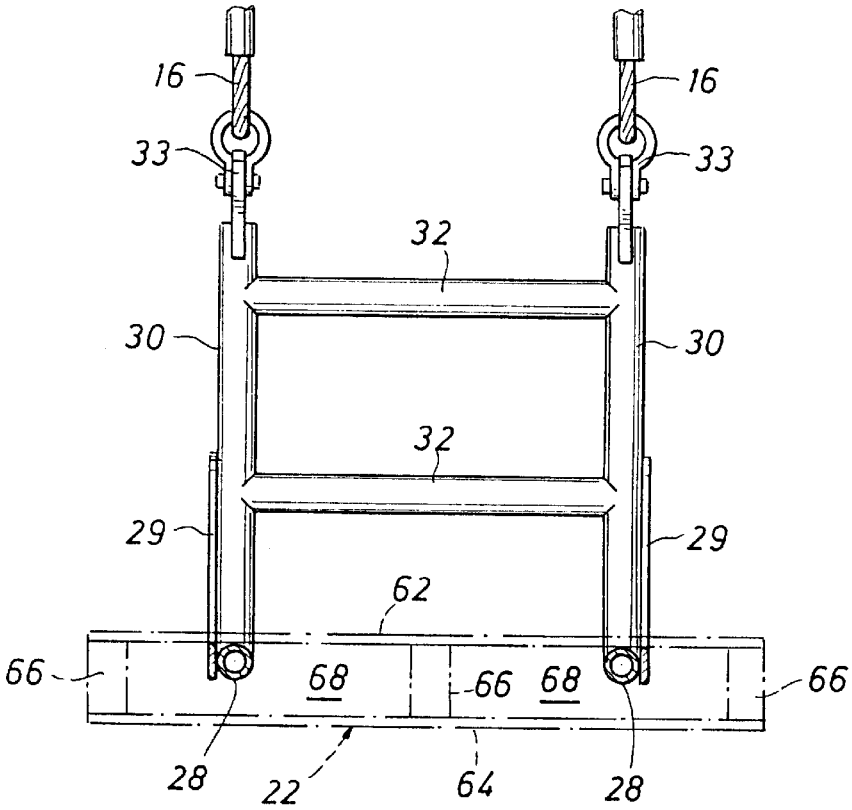
FIG. 3 is a front elevational view of the lifting frame shown in FIG. 2 taken generally along line 3—3 of FIG. 2.

Referring to FIG. 3, pallet 22 is shown in broken lines including an upper planking 62, a lower planking 64, and stringers or beams 66 extending between and secured to upper planking 62 and lower planking 64. Openings 68 are formed between stringers 66. Load 24 is supported on upper planking 62.

For connecting or attaching rigid L-shaped lifting frame 12 to pallet 22, front cables 14 are first unhooked or disconnected from free ends 31 or legs 28 by rotating links 34 ninety degrees from the lifting position shown in FIG. 5 to align grooves 38 with lugs 40. Then links 34 may be slipped off the free tapered ends 31 of legs 28 with grooves 38 receiving lugs 40. Next, lifting legs 28 on lifting frame 12 are manually guided within openings 68 of pallet 22 with back frame members 30 adjacent a side of pallet 22. Back frame members 30 extend a substantial vertical distance from horizontal lifting legs 28 at least over one foot and preferably about 2 or more feet. The length of lifting legs 28 is sufficient for legs 28 to extend outwardly from pallet 22 at least about six inches when legs 28 are received within openings 68 as shown in FIGS. 1 and 4. Front cables 14 are then reattached to the extending free ends 31 of legs 28 by slipping links 34 with grooves 38 and lugs 40 aligned onto free ends 31 past lugs 40, and then rotating links 28 ninety degrees to the position of FIG. 5 so that lugs 40 prevent release of links 28. Pallet 24 may then be lifted.

When front cables 14 are disconnected from free ends 31 of legs 28 in an unloaded condition, spreader 20 minimizes any twisting of cables 14, 16 and lifting frame 12 as eyes 52 on spreader member 20 receive cables 14, 16. Further, spreader member 20 is a circular ring having a relatively small circular cross section to provide a reduced surface area to minimize the effect of wind currents for twisting of lift frame 12. Spreader member or ring 20, if contacting an obstruction when being lowered is free to slide in an upward direction along the cables rather than obstructing movement of the load, and may return downwardly against stops 54 from tautness of the cables.

A particular use of the lifting device 10 of the present invention is for the lifting of palletized loads from work boats onto fixed drilling platforms. However, lifting device 10 is suitable for lifting all types of palletized loads. From the above, it is apparent that a lifting device has been provided including a rigid L-shaped lifting frame which is easily mounted on a palletized load for lifting in a minimum of connection steps in a minimum of time.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A lifting device for a pallet comprising:

a rigid lower L-shaped lifting frame having a pair of horizontal legs engaging a lower horizontal surface of the pallet and a back frame member for fitting against a side of the pallet;

a pair of front cables connect to said legs at a location opposite said back frame member and extending upwardly from said legs;

a pair of rear cables connected to said back frame member and extending upwardly from said back frame member;

a disconnect member between each leg and a front cable to permit release of a front cable from each leg;

an upper lift member connected to the upper ends of said cables for transmitting a lifting force to said rigid L-shaped lifting frame; and a spreader member connected to said cables and movable along said cables to maintain said cables in a spaced relation to each other.

2. A lifting device as defined in claim 1, wherein said rigid L-shaped lifting frame comprises a pair of L-shaped rigid parallel side frame members each defining a leg and an upstanding vertical back frame member; and rigid cross members extending between and connecting said side frame members to each other.

3. A lifting device as defined in claim 1, wherein said legs upon release of said front cables are effective for fitting within openings in the pallet for lifting of said pallet.

4. A lifting device as defined in claim 1, wherein said spreader member comprises a rigid circular ring having a circular cross-section and eyes for receiving said cables, said spreader member being slidable along said cables.

5. A lifting device as defined in claim 1, wherein said disconnect member comprises an adjustable link connected to a front cable and having an opening to receive an associated leg therein, said link moveable manually between a lift position of the pallet in which said link is prevented from slipping off the end of said associated leg and a release position in which said link is in a non-lift position and may be slipped from the end of said associated leg.

6. A lifting device as defined in claim 5, wherein said associated leg has a lug extending from a side thereof, and said link has a slot communicating with said opening and in alignment with said lug to receive said lug in a non-lift position to permit slipping of said lug off said leg, said link being manually moved to a lift position in which said lug is out of alignment with said slot to prevent slipping of said link off said associated leg.

7. A lifting device for a pallet comprising:

a rigid lower L-shaped lifting frame having a pair of L-shaped rigid lifting legs and an upstanding back frame member extending upwardly from a rear end of each leg;

a pair of rear cables connected to said back frame members;

a pair of front cables releasably connected to said legs at a free front end thereof opposite said back frame members; and a rigid spreader member receiving said rear and front cables to maintain said cables in a desired spaced relation to each other, said rigid spreader member slidable along said cables;

said front cables upon release from said legs permitting said free front ends of said legs to fit within openings in said pallet and to extend outwardly from said pallet, thereby to permit reattachment of said front cables to said free front ends of said legs after fitting of said legs within said openings for lifting said pallets.

8. A lifting device as defined in claim 7, wherein stops on said cables limit downward movement of said spreader member.

9. A lifting device as defined in claim 7, wherein said rigid spreader member comprises a circular ring having a circular cross section and eyes to receive said cables.

10. A lifting device as defined in claim 7, wherein said upstanding back frame members extend upwardly for at least one foot.

11. A lifting device as defined in claim 7, further comprising:

a manually operated disconnect member connected to each front cable for releasable connection to an associated leg, said disconnect member comprising an adjustable link connected to a front cable and having an opening to receive said associated leg therein, said link moveable manually between a lift position of the pallet in which said link is prevented from slipping off the end of said associated leg and a release position which said link is in a non-lift position and may be slipped from the end of said associated leg.

12. A lifting device as defined in claim 11, wherein said leg has a lug extending from a side thereof, said link has a slot communicating with said opening and in alignment with said lug to receive said lug in a non-lift position to permit slipping of said link off said associated lug, said link being manually rotated to a lift position in which said lug is out of alignment with said slot to prevent slipping of said link off said associated leg.

13. A method of lifting a palletized load with a lifting device having a rigid lower L-shaped lifting frame defining a pair of rigid lifting legs and a rigid back frame member extending upwardly from a rear end of said legs; said method comprising:

providing a pair of releasable cables connected to front free ends of said legs;

disconnecting said cables from said free ends of said legs;

inserting said free ends of said legs within openings in said palletized load with said rigid legs extending outwardly from said palletized load;

reconnecting said cables to said free ends of said legs for lifting of said palletized load;

connecting a pair of cables to said back frame member;

connecting a spreader ring on said cables for said legs and said back frame member with said cables maintained in a spaced relation to each other in said spreader ring; and permitting upward sliding movement of said spreader ring along said cables from a lower selected position.

14. A method of lifting a pallet having a load thereon with the rigid lower L-shaped lifting frame defining a pair of rigid lifting legs and a rigid upstanding back frame member extending upwardly from said legs; said method comprising:

connecting a pair or releasable front cables to front free ends of said legs;

connecting a pair of rear cables to said rigid upstanding back frame member;

disconnecting said front cables from said free ends of said legs;

inserting said free ends of said legs within openings in the pallet with the back frame member extending upwardly from said pallet and said rigid legs extending outwardly from said pallet;

reconnecting said front cables to said free ends of said legs for lifting of said pallet and the load thereon; and placing a movable spreader ring on said cables for maintaining said cables in a space relation to each other.

15. A lifting device for a pallet comprising:

a rigid lower L-shaped lifting frame having a pair of horizontal legs engaging a lower horizontal surface of the pallet and a back frame member for fitting against a side of the pallet;

a pair of front cables connected to said legs at a location opposite said back frame member and extending upwardly from said legs;

a pair of rear cables connected to said back frame member and extending upwardly from said back frame member;

a disconnect member between each leg and a front cable to permit release of a front cable from each leg;

an upper lift member connect to the upper ends of said cables for transmitting a lifting force to said rigid L-shaped lifting frame;

said disconnect member comprising an adjustable link connected to a front cable and having an opening to receive an associated leg therein, said link rotated manually between a lift position of the pallet in which said link is prevented from slipping off the end of said associated leg and a release position in which said link is in a non-lift position and may be slipped from the end of said associated leg.

16. A lifting device as defined in claim 15, wherein said rigid L-shaped lifting frame comprises a pair of L-shaped rigid parallel side frame members each defining a leg and an upstanding vertical back frame member; and rigid cross members extending between and connecting said side frame members to each other.

17. A lifting device as defined in claim 15, wherein said legs upon release of said front cables are effective for fitting within openings in the pallet for lifting of said pallet.

18. A lifting device as defined in claim 15, wherein said associated leg has a lug thereon, and said link has a slot to receive said lug in a non-lift position to permit slipping of link off said associated lug said link being manually rotated to a lift position in which said lug prevents slipping of said link off said associated leg.

* * * * *